US005289876A

United States Patent [19]

Graham

[11] Patent Number: 5,289,876

[45] Date of Patent: Mar. 1, 1994

[54] COMPLETING WELLS IN INCOMPETENT FORMATIONS

[75] Inventor: Stephen A. Graham, Bellaire, Tex.

[73] Assignee: Natural Reserves Group, Inc., Houston, Tex.

[21] Appl. No.: 920,804

[22] Filed: Jul. 28, 1992

[51] Int. Cl.[5] ..... E21B 43/04

[52] U.S. Cl. ..... 166/276; 166/50; 166/51; 166/278

[58] Field of Search ..... 166/276, 278, 295, 285, 166/50, 51

[56] References Cited

U.S. PATENT DOCUMENTS

| | | | |
|---|---|---|---|
| 1,896,212 | 2/1933 | Woods | 166/276 |
| 2,207,345 | 7/1940 | Hammer | 166/285 |
| 2,288,556 | 6/1942 | Vollmer | 166/276 |
| 2,674,323 | 4/1954 | Cardwell | 166/276 |
| 2,855,994 | 10/1958 | Kammerer, Jr. | 175/385 X |
| 3,301,339 | 1/1967 | Pennebaker, Jr. | 175/387 |
| 4,589,490 | 5/1986 | Darr et al. | 166/276 |
| 4,869,323 | 9/1989 | Stagg | 166/285 |
| 4,928,763 | 5/1990 | Falk | 166/50 X |
| 5,058,676 | 10/1991 | Fitzpatrick et al. | 166/295 X |
| 5,095,987 | 3/1992 | Weaver et al. | 166/276 |

*Primary Examiner*—Hoang C. Dang
*Attorney, Agent, or Firm*—G. Turner Moller

[57] ABSTRACT

A method of completing a horizontal well in an incompetent formation includes running a pipe string into the horizontal well bore, pumping a hardenable permeable material into the horizontal well bore, allowing the hardenable material to set up and then drilling up at least part of the pipe string. The hardenable permeable material may be resin coated sand providing sand control for the incompetent formation. In the event the horizontal bore hole vertically meanders out of a desired path and falls below an oil-water contact or rises above a gas-oil contact, that portion of the pipe string located out of the desired path is not drilled up thereby deterring production of undesired formation fluids.

16 Claims, 4 Drawing Sheets

COMPLETING WELLS IN INCOMPETENT FORMATIONS

This invention relates to a technique for completing producing or injection wells in incompetent formations to recover hydrocarbons.

Although this invention has some application in vertical and deviated wells, it is most applicable and will be described in conjunction with horizontal wells, or more accurately, wells with horizontal sections. Horizontally drilled wells have recently become quite popular in attempting to make commercial wells in vertically fractured formations, such as the Austin Chalk or Bakken Shale. Horizontally drilled wells also have many advantages in sandstone or limestone/dolomite reservoirs having matrix porosity. Horizontal wells produce a great deal more because more of the formation is exposed to the well bore. In addition, the "linear flow" characteristics produce much lower flow velocities near the well bore and have much smaller pressure drops near the well bore when compared to the "radial flow" characteristics inherent in vertical wells.

There are a number of situations where conventionally completed horizontally drilled wells are impractical, haven't worked out well or haven't been attempted because of anticipated problems. One such situation is where the producing formation is incompetent, i.e. is prone to disintegrate or collapse in the course of production. Typically, but not universally, incompetent formations are shallow, relatively unconsolidated sandstones. One common production problem in incompetent formations is the production of large quantities of sand. Although horizontal completions should reduce sand problems because of lower flow velocities adjacent the well bore, there is no doubt that sand can be produced.

This invention is particularly applicable to the completion of horizontal drain holes in incompetent formations. A vertical well bore is drilled to adjacent a hydrocarbon bearing formation. The well is deviated through a curved well bore section and a more-or-less horizontal well bore is drilled for a substantial distance through the formation. A pipe string is run into the curved and horizontal well bores and a permeable hardenable material, such as resin coated sand, is pumped into the annulus between the horizontal well bore and the pipe string. An impermeable hardenable material, such as cement, may be pumped into the annulus between the curved well bore and the pipe string to minimize gas and/or steam coning in the portion of the drain hole above the horizontal target zone. After the hardenable materials have set up, at least part of the pipe string in the horizontal well bore is drilled up thereby leaving a long section of productive formation communicating with a production string and providing an annulus of sand control material preventing sand entry into the well.

Disclosures of some interest are found in U.S. Pat. Nos. 3,887,021; 3,908,759; 4,396,075; 4,402,551; 4,415,205; 4,436,165; 4,553,595; 4,714,117; 4,750,561; 4,807,704; 4,880,059; 4,915,175; 4,928,763; 4,995,456; 5,040,601 and 5,058,677.

It is an object of this invention to provide an improved completion technique for horizontal drain holes.

Another object of this invention is to provide an improved technique for completing horizontal well bores in incompetent formations prone to produce formation solids and/or experience hole collapse problems.

These and other objects of this invention will become more fully apparent as this description proceeds, reference being made to the accompanying drawings and appended claims.

IN THE DRAWINGS

Figure 1:
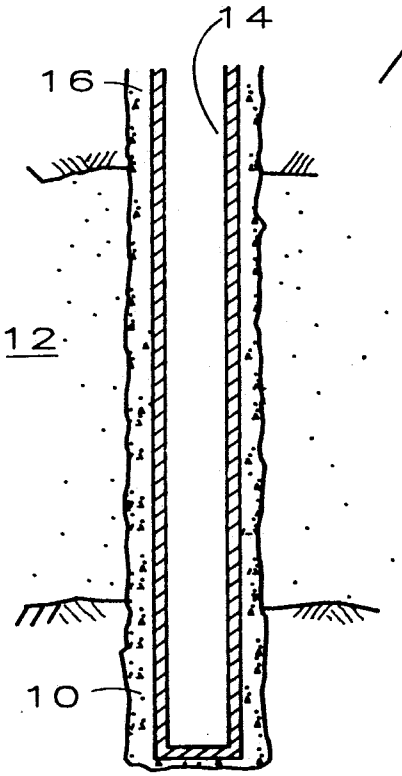
FIG. 1 is a schematic view of a first stage of drilling and completing a horizontal drain hole in accordance with this invention.

Referring to FIG. 1, a vertical well bore 10 is drilled into the earth and penetrates a subterranean hydrocarbon bearing formation 12. Typically, the well bore 10 is logged to provide reliable information about the top and bottom, fluid content, porosity and other petrophysical information of the formations encountered. A relatively large casing string 14, e.g. 7" O.D. or greater, is cemented in the well bore 10 in any suitable manner so a cement sheath 16 prevents communication between formations in the annulus between the well bore 10 and any perforations or openings in the casing string 14.

Figure 2:
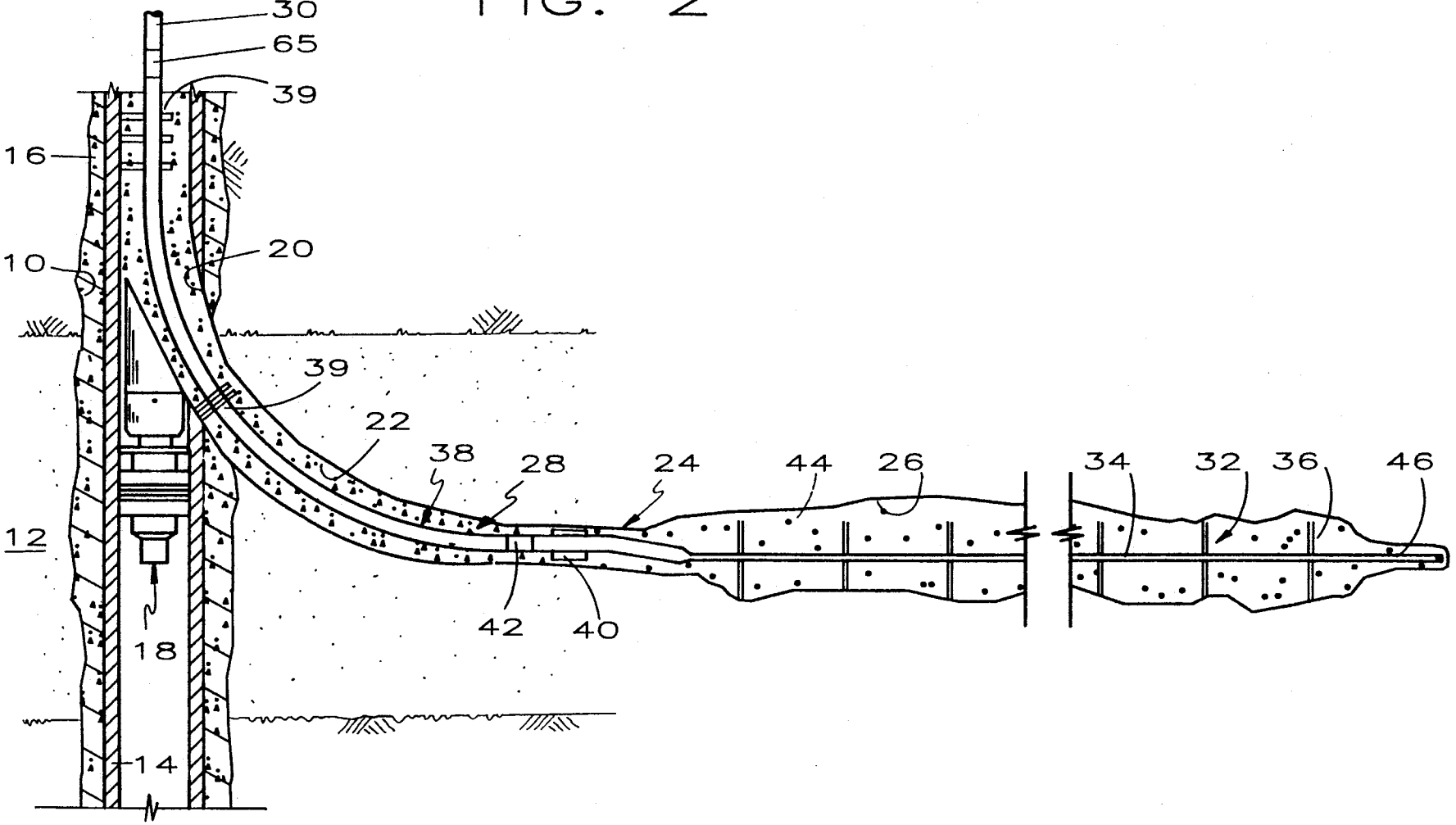
FIGS. 2–4 are schematic views of subsequent stages of drilling and completing a horizontal drain hole in accordance with this invention.

Referring to FIG. 2, a whipstock 18 is set where the well is to be sidetracked, a window 20 is cut in the casing string 14 and a curved bore hole 22 is drilled, preferably on a short radius, to intersect the formation 12. The angle of the curved bore hole 22 is increased as drilling proceeds and a more-or-less horizontal bore hole 24 is drilled for a substantial length through the formation 12. Preferably, a substantial portion 26 of the horizontal bore hole 24 is reamed to a larger diameter in any suitable fashion, as by the use of an expandable underreamer.

A pipe string 28 is run into the curved and horizontal well bores 22, 24 on the end of a work string 30. The pipe string 28 is of sufficient flexibility to easily negotiate the bend of the arcuate well bore 22. If the curved well bore 22 is of a long enough radius to easily pass conventional drill pipe, the selection of the pipe string 28 is relatively easy. In this situation, the pipe string 28 includes a lower section 32 in the horizontal well bore 24 comprising a plurality of tubular joints 34 of an easily drillable material such as fiberglass, plastic, carbon/glass/epoxy composite, aluminum or the like a having a plurality of flexible centralizers 36 thereon. The pipe string 28 also includes an upper section 38 of sufficient flexibility to pass the curved well bore section 22. For purposes more fully apparent hereinafter, the lower pipe section 32 is of smaller I.D. than the upper pipe section 38. In relatively short radius curved bore holes 22, the pipe section 38 may comprise a high strength, flexible carbon/glass/epoxy casing joints or a segmented, articulated pipe section having a reinforced rubber hose therein. One or more rigid centralizers 39 may be affixed to the pipe string section 38 to support the pipe section 38 away from the bore hole wall. An external casing packer 40 and a sliding sleeve 42 are provided near the junction of the pipe sections 32, 38 for purposes more fully apparent hereinafter.

A quantity of permeable hardenable material 44 such as a curable resin coated sand or proppant slurry, followed by one or more wiper plugs (not shown), is pumped down the work string 30 and pipe string 28 and exits through the end 46 of the pipe string section 32. The quantity of resin coated sand slurry 44 is selected to be sufficient to fill the horizontal well bore section 24 and at least part of the curved well bore section 22. The resin coated sand slurry 44 circulates in the annulus between the pipe string 28 and the well bore sections 22, 24. The resin coated sand slurry 44 substantially fills the horizontal well bore 24. As soon as the wiper plugs arrive at the pipe string end 46, the external casing packer 40 is inflated.

This is accomplished in any suitable manner, preferably by breaking a shear plug in the packer 40 with the same wiper plugs (no shown) used to displace the resin coated sand slurry from the pipe string 28. The packer 40 is then inflated simply by pumping into the work string 30. The sliding sleeve 42 is then opened by a tool (not shown) conveyed by a coiled tubing string (not shown).

Figure 3:
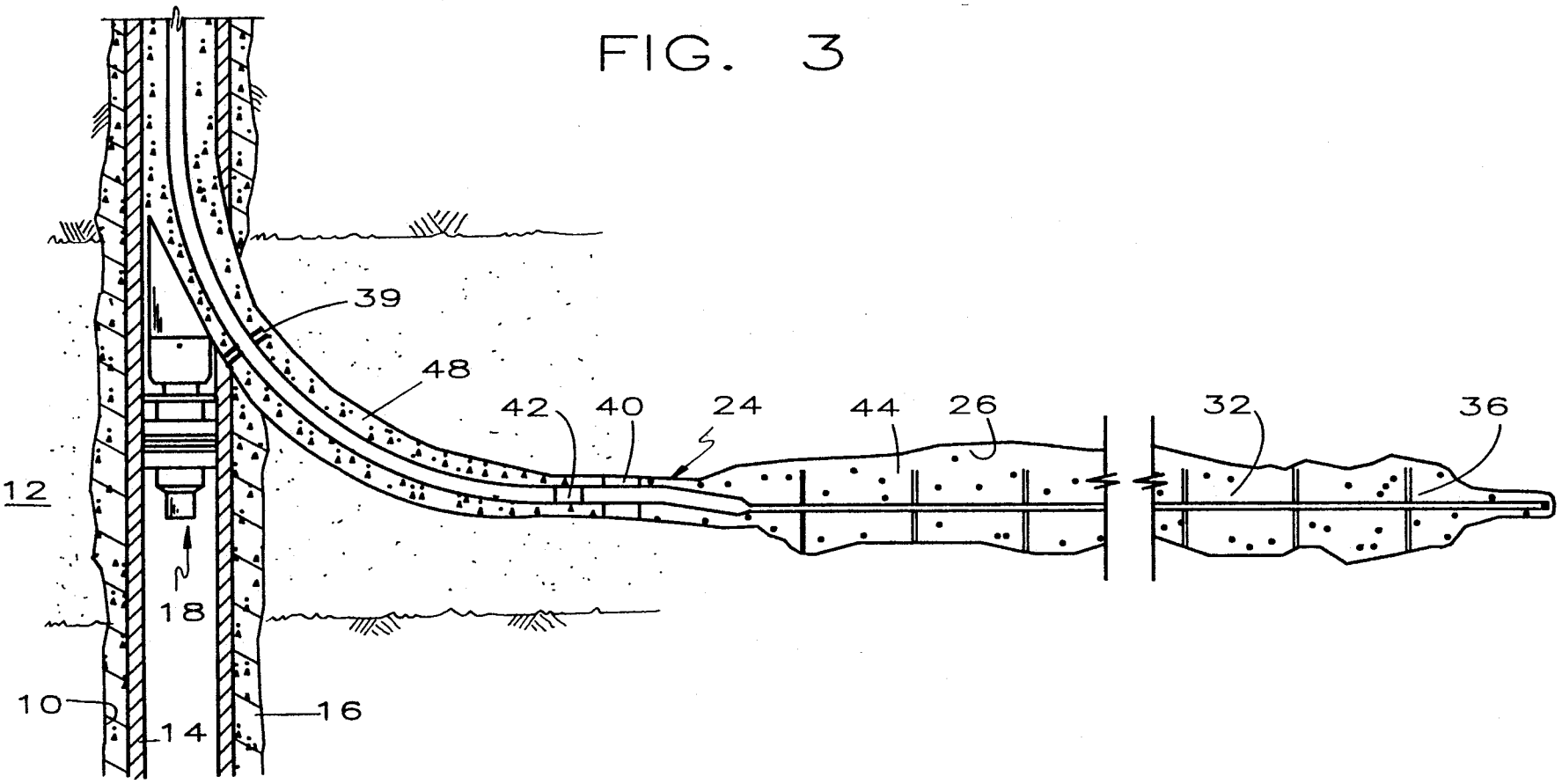

As shown in FIG. 3, a quantity of impermeable hardenable material 48, such as cement slurry, is pumped into the work string 30, exits through the sliding sleeve 42 and displaces any resin coated sand slurry upwardly into the vertical well section. Preferably, the cement slurry is displaced by any suitable liquid, such as gelled water, without the use of a wiper plug so it does not have to be drilled up later. The top of the cement slurry inside the pipe string section 38 is preferably somewhat above the sliding sleeve 42. The top of the cement slurry inside the casing string 14 is high enough to completely close the window 20. The sliding sleeve 42 is then closed with a tool (not shown) on the end of a coiled tubing string and the pipe string section 38 is circulated with gelled water or the like to displace any cement slurry in the pipe string to the surface.

Figures 4, 5:
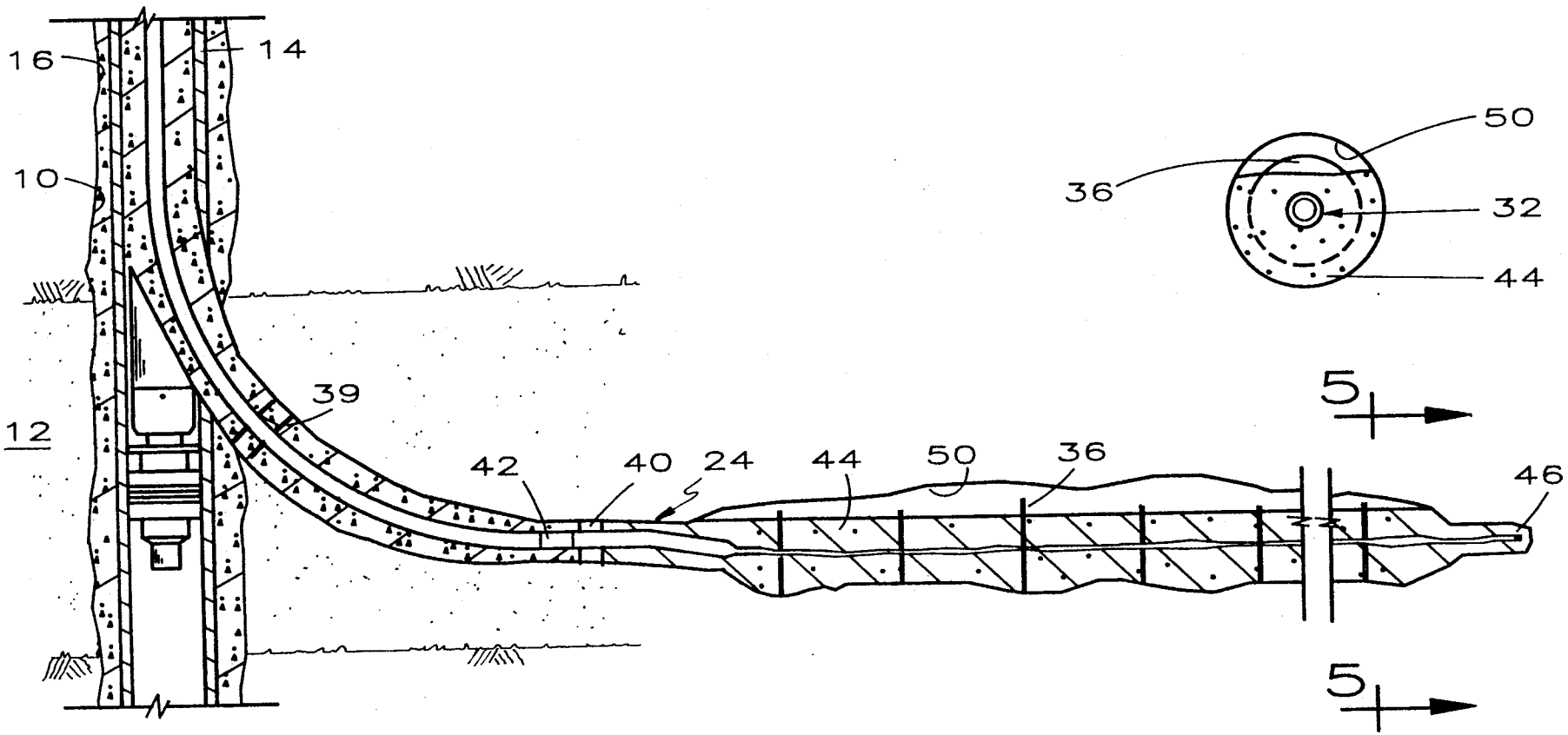
FIG. 5 is a cross-sectional view of FIG. 4, taken substantially along line 5—5 thereof, taken before the pipe string has been drilled out.

As shown in FIGS. 4 and 5, the resin coated sand slurry 44 and the cement slurry 48 are allowed to set up. The resin coated sand slurry 44 shrinks somewhat as it sets up leaving a cavity 50 adjacent the top of the enlarged well bore section 26. The centralizers 36 position the pipe section 32 off the bottom of the expanded well bore 26 so there is adequate resin coated sand 44 on all sides of the pipe section 32. It will be apparent that the enlarged well bore section 26 may be made as large as desired so the thickness of the resin coated sand 44 may be large. This increases the surface area of the resin coated sand body without reducing the internal diameter of the pipe section 32 because the sand control material is on the outside of the pipe section 32.

Figure 6:
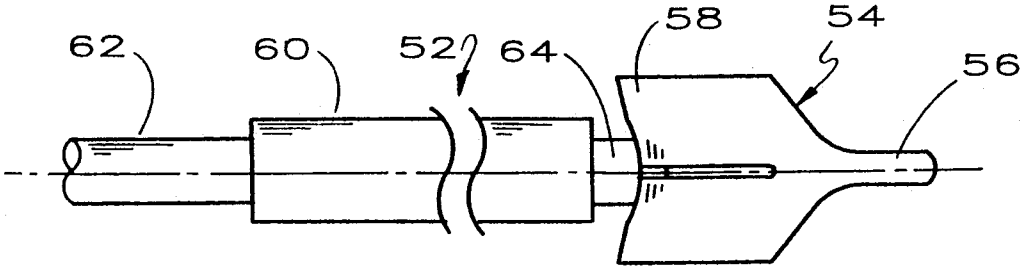
FIG. 6 is an enlarged view of a drilling assembly used to drill up part of the pipe string of FIGS. 2–5.

Referring to FIG. 6, a drilling assembly 52 comprises a pilot mill 54 having a pilot section 56 sized to be closely received in the pipe section 32 and a plurality of blades 58. The drilling assembly 52 also includes a mud motor 60 on the end of a coiled tubing string 62. The drilling assembly 52 is run into the work string 30 and through the pipe string section 38 until the pilot section 56 enters the drillable pipe section 32. Gelled water or foam is circulated down the coiled tubing 62 to drive the mud motor 60 and rotate the output 64 and thereby rotate the pilot mill 54 to comminute or drill up the pipe section 32. The coiled tubing 62 is advanced so the mill 54 drills up all but the last few feet of the drillable pipe section 32 as shown in FIG. 4.

After the desired part of the pipe section 32 has been drilled up, the well is completed in a conventional manner. The work string 30 is removed from an on-off tool 65 which is above the top of the cement in the vertical cased well bore 10. A tubing string and packer (not shown) are run into the well and may be attached to the on-off tool 65. Conventional production equipment is installed at the surface and the well is conventionally swabbed in.

Figure 7:
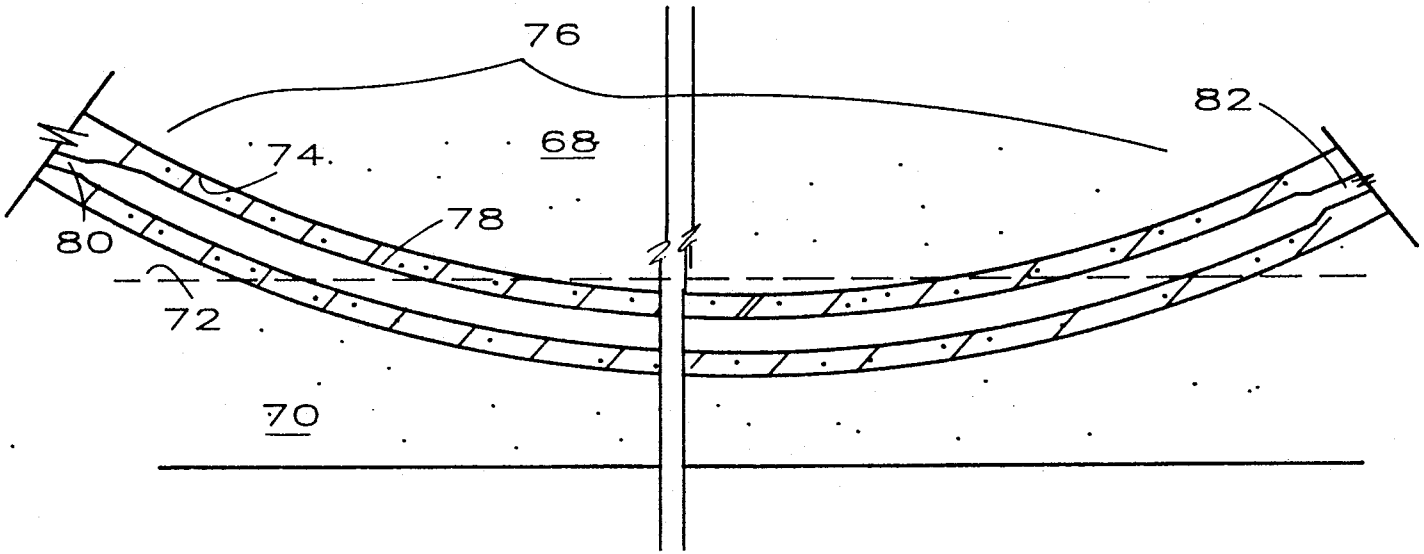
FIG. 7 is cross-sectional view of a partial schematic view of a horizontal well showing another feature of the invention.

Referring to FIG. 7, another feature of the invention is illustrated. Present technology allows the vertical and horizontal position of the horizontal well bore to be very well controlled. Even so, there are situations where the well bore meanders upwardly into a gas bearing zone or downwardly into a water bearing zone. In FIG. 7, the formation includes a hydrocarbon bearing section 68, a water bearing section 70 and an oil-water contact 72 separating the two. The bore hole 74 has inadvertently meandered downwardly into the underlying water bearing section 70. This is discovered either by a study of the directional surveys of the well bore 74, by an examination of a well log run in the well bore 74 or a combination thereof. To prevent excessive water production, it is desirable to shut off a zone 76 where the bore hole 74 is below or too close to the oil water contact 72 and prevent entry of undesired formation fluids into the production string.

To this end, a pipe section 78 with an internal diameter slightly larger than the outer diameter of the pilot mill 54 is placed between one or more drillable pipe sections 80, 82 throughout whatever zone 76 is desired to be shut off. Preferably, the pipe section 78 is a lightweight composite carbon/glass/epoxy material although it may be metal. A permeable hardenable material 77 is pumped into the annulus between the pipe sections 78, 80, 82 and the bore hole 74 and allowed to set up. When the pilot mill 54 has drilled up the pipe section 80 and approaches the larger pipe section 78, it simply passes through the center and does not begin drilling again until it enters the drillable pipe section 82.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A method of completing a well in an incompetent subterranean formation, comprising drilling a bore hole into the subterranean formation;

running a pipe string into the bore hole;

filling up an annulus between the pipe string and the bore hole with a hardenable permeable material; and then drilling up a substantial extent of the pipe string leaving a section of hardenable permeable material in the bore hole, the section of hardenable permeable material having a passage therethrough parallel to the bore hole; and then delivering a formation fluid through the hardenable permeable material and through an in contact with the passage.

2. The method of claim 1 wherein the step of drilling a bore hole comprises drilling a curved bore hole to intersect the subterranean formation and then drilling a long generally horizontal bore hole in the subterranean formation, the step of running a pipe string into the bore hole comprises running a pipe string into the curved bore hole and into the horizontal bore hole, the filling up step comprises filling up an annulus between the pipe string and the horizontal bore hole with a hardenable permeable material, and the drilling up step comprises drilling up a substantial horizontal extent of the pipe string in the horizontal bore hole.

3. The method of claim 2 further comprising drilling a vertical bore hole through the subterranean formation, logging the vertical well bore and then drilling the curved bore hole.

4. The method of claim 3 wherein the step of drilling the curved bore hole section comprises drilling the curved bore hole by exiting from the vertical bore hole at a location above the bottom of the vertical bore hole.

5. The method of claim 2 wherein the filling up step comprises filling up an annulus between the pipe string and the curved bore hole with an impermeable hardenable material.

6. The method of claim 5 wherein the hardenable material in the curved bore hole comprises cement.

7. The method of claim 2 wherein the permeable hardenable material comprises a resin coated granular material.

8. The method of claim 2 wherein the drilling up step comprises running an assembly into the pipe string in the horizontal bore hole comprising a pilot section having a forward free end closely received in the pipe string and a plurality of blades connected to the pilot section and then rotating and advancing the assembly.

9. The method of claim 2 wherein the subterranean formation comprises a vertical section where the horizontal well bore is desired to be and further comprising the step of determining the horizontal location of a section of the horizontal well bore located out of the vertical section, the drilling up step comprising drilling up part of the pipe string in the horizontal bore hole away from the horizontal location and leaving the pipe string in the section of the horizontal well bore located out of the vertical section.

10. The method of claim 1 wherein the delivering step comprises producing a formation fluid through the hardenable permeable material and then through and in contact with the passage.

11. A method of completing a well comprising a generally vertical section, a curved section and a generally horizontal section in an incompetent subterranean formation, comprising running a pipe string into the curved well section and into the horizontal well section;

filling up an annulus between the pipe string and the horizontal well section with a permeable hardenable material; and then drilling up at least part of the pipe string in the horizontal section thereby providing a passage parallel to the horizontal well section through the permeable hardenable material; and then delivering a formation fluid through the hardenable permeable material and through an in contact with the passage.

12. The method of claim 11 wherein the permeable hardenable material comprises a resin coated granular material.

13. The method of claim 11 further comprising the step of filling up an annulus between the pipe string and the curved well bore section with an impermeable hardenable material.

14. The method of claim 11 wherein the delivering step comprises producing a formation fluid through the hardenable permeable material and then through and in contact with the passage.

15. A well having a vertical section, a curved section communicating with the vertical section and a generally horizontal section extending into an incompetent subterranean formation comprising an oil bearing section and a contiguous vertically spaced non-oil bearing section, the horizontal section comprises a horizontal well bore extending through the oil bearing section, extending in a zone through the non-oil bearing section and providing a formation fluid production axis and a generally annular sheath of permeable hardenable material in the horizontal well bore providing an outer surface in contact with the incompetent formation and an inner surface exposed to the axis providing a flow path away from the horizontal section, the well further comprising an imperforate conduit inside the passage in the zone in the non-oil bearing section.

16. A method of completing a horizontal well bore in an incompetent subterranean formation comprising a vertical section where the horizontal well bore is desired to be, comprising drilling a bore hole into the subterranean formation including drilling a curved bore hole to intersect the subterranean formation and then drilling a long generally horizontal bore hole in the subterranean formation, determining the horizontal location of a section of the horizontal well bore located out of the vertical section, running a pipe string into the curved bore hole and into the horizontal bore hole;

filling up an annulus between the pipe string and the bore hole with a hardenable permeable material; and then drilling up a substantial horizontal extend of the pipe string away from the horizontal location leaving a section of hardenable permeable material in the bore hole having a passage therethrough and leaving the pipe string int he section of the horizontal well bore located out of the vertical section.

* * * * *